US008561582B2

(12) United States Patent
Deneri

(10) Patent No.: US 8,561,582 B2
(45) Date of Patent: Oct. 22, 2013

(54) DEVICE FOR VARIABLY ADJUSTING THE VALVE TIMING OF GAS EXCHANGE VALVES OF AN INTERNAL COMBUSTION ENGINE

(75) Inventor: Ahmet Deneri, Wiesenttal (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 227 days.

(21) Appl. No.: 13/003,663

(22) PCT Filed: Jun. 10, 2009

(86) PCT No.: PCT/EP2009/057164

§ 371 (c)(1),
(2), (4) Date: Mar. 2, 2011

(87) PCT Pub. No.: WO2010/006855

PCT Pub. Date: Jan. 21, 2010

(65) Prior Publication Data

US 2012/0103288 A1 May 3, 2012

(30) Foreign Application Priority Data

Jul. 12, 2008 (DE) ..... 10 2008 032 949

(51) Int. Cl.
*F01L 1/34* (2006.01)

(52) U.S. Cl.
USPC ..... 123/90.17; 123/90.34

(58) Field of Classification Search
USPC ..... 123/90.15, 90.17, 90.12, 90.34
See application file for complete search history.

(56) References Cited

U.S. PATENT DOCUMENTS

| | | | | |
|---|---|---|---|---|
| 4,577,592 | A | 3/1986 | Bosch | |
| 5,901,674 | A | 5/1999 | Fujiwaki | |
| 6,405,695 | B2 * | 6/2002 | Mizutani et al. | 123/90.17 |
| 6,820,578 | B2 * | 11/2004 | Kanada et al. | 123/90.15 |
| 6,845,740 | B2 * | 1/2005 | Kohrs | 123/90.17 |
| 7,182,052 | B2 * | 2/2007 | Yaoko et al. | 123/90.17 |
| 7,931,000 | B2 * | 4/2011 | Ushida et al. | 123/90.17 |
| 2003/0116110 | A1 | 6/2003 | Kohrs | |
| 2003/0221647 | A1 * | 12/2003 | Kobayashi et al. | 123/90.17 |
| 2010/0089353 | A1 * | 4/2010 | Myers et al. | 123/90.17 |

FOREIGN PATENT DOCUMENTS

| | | | |
|---|---|---|---|
| DE | 101 43 862 | A1 | 3/2003 |
| DE | 101 61 698 | A1 | 6/2003 |
| DE | 10 2004 019 190 | A1 | 11/2005 |
| DE | 10 2004 038 695 | A1 | 2/2006 |
| DE | 10 2006 036 034 | A1 | 2/2008 |
| EP | 1 471 215 | A | 10/2004 |

* cited by examiner

*Primary Examiner* — Thomas Denion
*Assistant Examiner* — Daniel Bernstein
(74) *Attorney, Agent, or Firm* — Lucas & Mercanti, LLP

(57) ABSTRACT

A device for variably adjusting the valve timing of gas exchange valves of an internal combustion engine which has an input element, an output element and a camshaft. The input element can be brought in a driving connection with the crankshaft of the internal combustion engine. The output element is non-rotationally connected to the camshaft and swivelable in relation to the input element. An axial lateral face of the camshaft rests against an axial lateral face of the output element. A form-locking element on one of the axial lateral faces resting against each other aligns the output element on the camshaft with respect to its circumferential direction and engages in a mating form-locking element of the other component.

6 Claims, 2 Drawing Sheets

DEVICE FOR VARIABLY ADJUSTING THE VALVE TIMING OF GAS EXCHANGE VALVES OF AN INTERNAL COMBUSTION ENGINE

This application is a 371 of PCT/EP2009/057164 filed Jun. 10, 2009, which in turn claims the priority of DE 10 2008 032 949.5 filed Jul. 12, 2008, the priority of both applications is hereby claimed and both applications are incorporated by reference herein.

FIELD OF THE INVENTION

The invention relates to a device for variably adjusting the valve timing of gas exchange valves of an internal combustion engine having a drive element, an output element and a camshaft, it being possible for the drive element to be brought into a drive connection with a crankshaft of the internal combustion engine, the output element being connected fixedly to the camshaft so as to rotate with it and being arranged pivotably with respect to the drive element, an axial side face of the camshaft bearing against an axial side face of the output element, a positively locking element which engages into a mating positively locking element of the other component being provided on one of the axial side faces which lie on one another, for orienting the output element on the camshaft with regard to its circumferential direction.

BACKGROUND OF THE INVENTION

In modern internal combustion engines, devices for variably adjusting the valve timing of gas exchange valves are used, in order for it to be possible to variably configure the phase relation between the crankshaft and the camshaft in a defined angular range, between a maximum early and a maximum late position. For this purpose, the device is integrated into a drive train, via which torque is transmitted from the crankshaft to the camshaft. Said drive train can be realized, for example, as a belt, chain or gearwheel drive.

A device of this type is known, for example, from U.S. Pat. No. 5,901,674 A. The device comprises an output element which is arranged rotatably with respect to a drive element, the drive element being in a drive connection with the crankshaft and the output element being connected fixedly to the camshaft so as to rotate with it. The device is delimited in the axial direction by in each case one side cover. The output element, the drive element and the two side covers delimit five pressure spaces, each of the pressure spaces being divided by means of a vane into two pressure chambers which act counter to one another. As a result of the feeding of pressure medium to or the discharge of pressure medium from the pressure chambers, the vanes are displaced within the pressure spaces in the circumferential direction of the device, as a result of which a targeted rotation of the output element with respect to the drive element and therefore of the camshaft with respect to the crankshaft is brought about. A plurality of axial pressure medium lines which are configured as holes are provided within the camshaft. Pressure medium can be fed to the pressure chambers via said pressure medium lines. Each of the pressure medium lines which are formed within the camshaft opens on the axial side face of the camshaft into a corresponding pressure medium line which are configured as holes in the output element and communicate with at least one of the pressure chambers. Here, the opening of one pressure medium line lies directly opposite the opening of the second pressure medium line in the axial direction.

It is disadvantageous in this embodiment that it has to be ensured during the mounting of the output element on the camshaft that the holes of the output element are aligned with the holes of the camshaft. Deviations of the orientation in the circumferential direction lead to alignment errors, as a result of which a throttling point is produced at the interface between the camshaft and the output element. This impairs the adjusting speed and the dynamics of the phase adjustment. In the case of excessively large deviations, the alignment error can also lead to the complete non-functionality of the device.

The orientation of the components with respect to one another is usually ensured by press-in pins. To this end, a hole is provided both in the camshaft and in the output element. During the mounting of the output element on the camshaft, a pin is pressed into the hole of the output element, which pin is subsequently likewise fixed nonpositively in the hole of the camshaft. However, this is a complex and expensive manufacturing process with multiple stages. In addition, tolerance deviations of the openings with respect to one another cannot be compensated for on account of the double press fit of the pin. As a result, throttling effects can occur at the interface between the output element and the camshaft despite the orientation of the components with respect to one another.

OBJECT OF THE INVENTION

The invention is based on the object of providing a device for variably adjusting the valve timing of gas exchange valves of an internal combustion engine, the orientation of the output element with respect to the camshaft taking place in the circumferential direction during the mounting by a reliable process, without increasing production and mounting costs.

According to the invention, the object is achieved by the fact that the positively locking element and the mating positively locking element are configured in one piece with the corresponding component.

In one specific embodiment of the invention there is provision for the positively locking element to be configured as an axial projection on one of the side faces.

The device has at least one drive element and at least one output element. In the mounted state of the device, the drive element is in a drive connection with the crankshaft via a traction mechanism drive, for example a belt or chain drive, or a gearwheel drive. The output element is arranged such that it can be pivoted in a defined angular range relative to the drive element and is connected fixedly to the camshaft so as to rotate with it. Here, an axial side face of the camshaft bears against an axial side face of the output element. The rotationally fixed connection between the camshaft and the output element can be produced, for example, by means of a central screw which engages through the output element and engages into a threaded section of the camshaft, with the result that a frictional connection is produced between the side faces which bear against one another.

In order to make a positionally accurate orientation of the components in the circumferential direction relative to one another possible during the mounting of the output element on the camshaft, a positively locking element is provided on one of the components, which positively locking element, in the case of a positionally accurate orientation with respect to one another, engages into a mating positively locking element which is formed on the other component.

Here, the positively locking element is configured in one piece with the output element or the camshaft. In addition, the mating positively locking element is configured in one piece with the other component.

For example, the positively locking element may be configured as an axial projection on the axial side face of the output element. In this case, the mating positively locking element is configured as an axial cutout on the axial side face of the camshaft, its contour being configured so as to correspond with the contour of the positively locking element. Here, this may be, for example, a freestanding projection or be formed as a deviation from an otherwise rotationally symmetrical structure. During the mounting, the axial projection prevents the output element from being incorrectly mounted on the camshaft.

This single piece configuration of the positively locking element with the output element or the camshaft represents an inexpensive alternative to the pins which are provided in the prior art, are produced separately and are connected non-positively with the components. On account of the enlarged first and/or second openings, the positively locking element can have higher tolerances without impeding the pressure medium transfer. Complicated post-machining steps are not necessary.

In the case of output elements of sintered construction, for example, the positively locking element can already be taken into consideration in the sintering tool, as a result of which its formation does not cause any additional costs.

Furthermore, there may be provision for the output element to have a centering collar for receiving the camshaft. In this case, in addition to the fixing of the output element relative to the camshaft in the axial direction and in the circumferential direction, radial centering also takes place before the start of the fastening operation. The centering collar may be configured, for example, as a structure which projects out of the side face of the output element. Structures which are complete or discontinuous in the circumferential direction are conceivable here, for example. The centering collar may likewise be formed by formation of a depression in the axial side face of the output element.

In one advantageous development of this embodiment, the positively locking element may be configured as a radial bulge on the centering collar. Bulges of the centering collar radially to the inside or outside are conceivable here, for example. The bulges extend over an angular range of less than or equal to 180°. In this case, the mating positively locking element is to be configured as a corresponding indentation or bulge on the camshaft.

BRIEF DESCRIPTION OF THE DRAWINGS

Further features of the invention result from the following description and from the drawings, in which exemplary embodiments of the invention are shown in simplified form and.

DETAILED DESCRIPTION OF THE DRAWINGS

Figure 1:
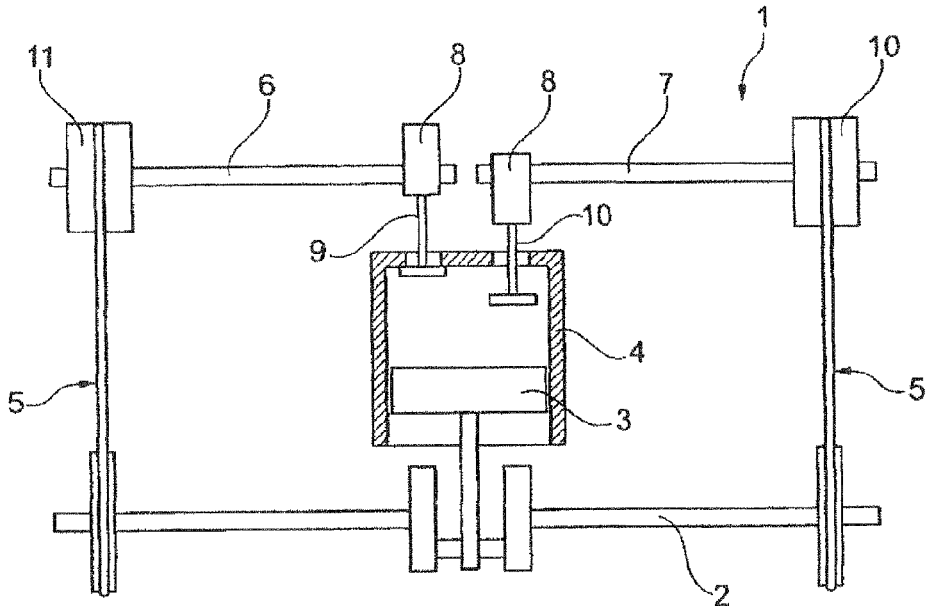
FIG. 1 shows an internal combustion engine only in a very schematic form.

FIG. 1 outlines an internal combustion engine 1, a piston 3 which is seated on a crankshaft 2 being indicated in a cylinder 4. In the embodiment which is shown, the crankshaft 2 is connected via in each case one traction mechanism drive 5 to an inlet camshaft 6 and outlet camshaft 7, it being possible for a first and a second device 11 to ensure a relative rotation between the crankshaft 2 and the camshafts 6, 7. Cams 8 of the camshafts 6, 7 actuate one or more inlet gas exchange valves 9 or one or more outlet gas exchange valves 10. There can likewise be provision to equip only one of the camshafts 6, 7 with a device 11, or to provide only one camshaft 6, 7, and to equip the latter with a device 11.

Figure 2:
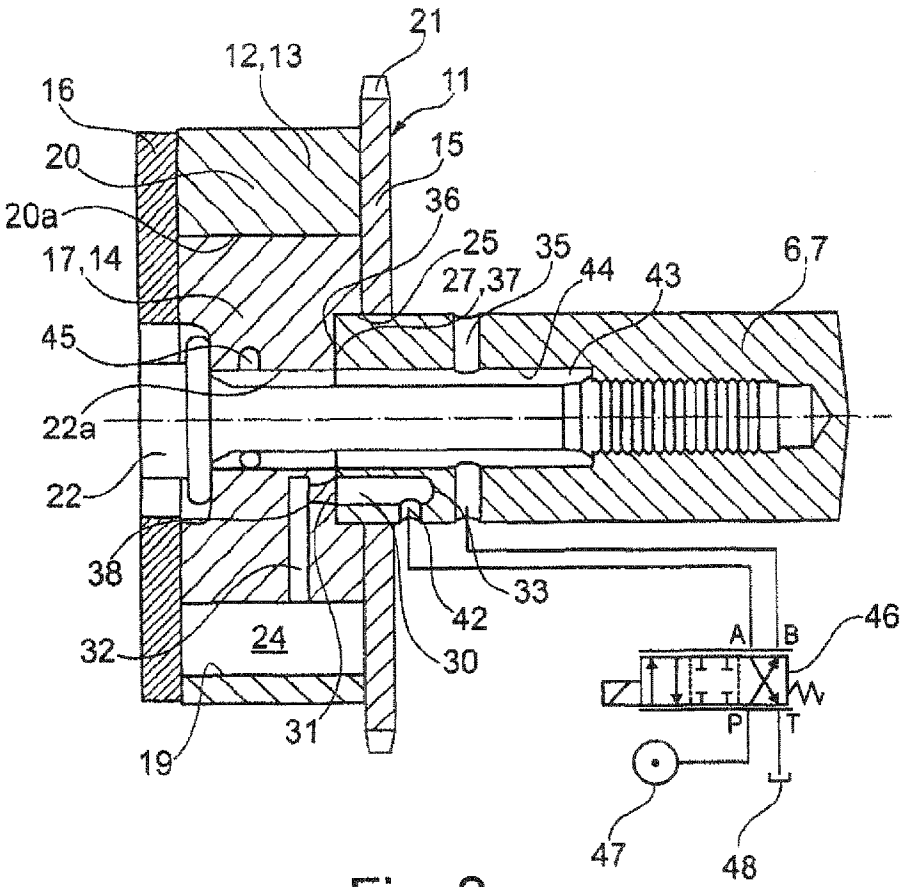
FIG. 2 shows a longitudinal section through one embodiment according to the invention of a device for adjusting the valve timing of gas exchange valves of an internal combustion engine.

FIG. 2 shows one embodiment of a device 11 according to the invention in longitudinal section. The device 11 has a drive element 12 and an output element 14. The drive element 12 has a housing 13 and two side covers 15, 16 which are arranged on the axial side faces of the housing 13. Starting from an outer circumferential wall 19 of the housing 13, five projections 20 extend radially to the inside. In the embodiment which is shown, the projections 20 are configured in one piece with the circumferential wall 19. The drive element 12 is arranged relative to the output element 14 such that it can be rotated with respect to the latter by means of radially inwardly lying bearing faces 20*a* of the projections 20.

Figure 3:
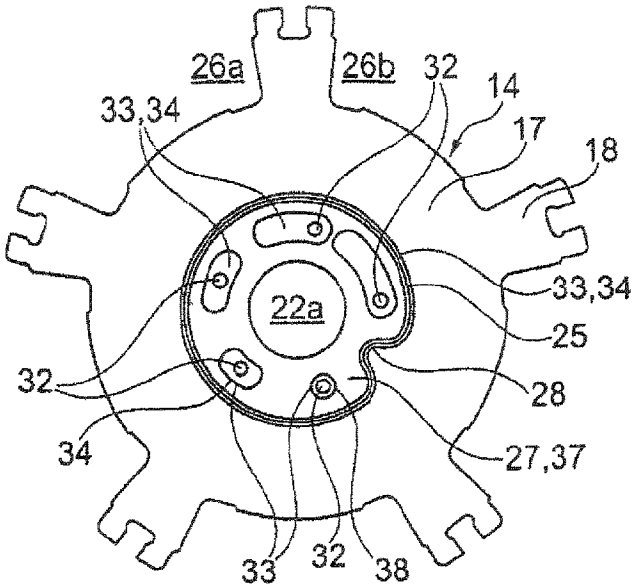
FIG. 3 shows a plan view of the output element from FIG. 2.

The output element 14 which is shown in FIG. 3 is configured in the form of an impeller wheel and has a substantially cylindrically configured hub element 17, from the outer cylindrical circumferential face of which five vanes 18 extend in the radial direction to the outside in the embodiment which is shown. The vanes 18 are configured in one piece with the hub element 17.

A chain sprocket 21 is formed on an outer circumferential face of the first side cover 15, via which chain sprocket 21 torque can be transmitted from the crankshaft 2 to the drive element 12 by means of a chain drive (not shown). The output element 14 is connected to the camshaft 6, 7 by means of a central screw 22. To this end, the central screw 22 reaches through a central hole 22*a* of the output element 14 and is screwed to the camshaft 6, 7.

In each case one of the side covers 15, 16 is arranged on one of the axial side faces of the housing 13 and is fastened firmly to the latter so as to rotate with it. For this purpose, fastening elements are provided which reach through in each case one projection 20 and both side covers 15, 16 and fix to one another.

A pressure space 24 is formed within the device 11 between in each case two adjacent projections 20 in the circumferential direction. Each of the pressure spaces 24 is delimited in the circumferential direction by opposite, substantially radially extending bounding walls of adjacent projections 20, in the axial direction by the side covers 15, 16, radially to the inside by the hub element 17 and radially to the outside by the circumferential wall 19. A vane 18 protrudes into each of the pressure spaces 24, the vanes 18 being configured in such a way that they bear both against the side covers 15, 16 and against the circumferential wall 19. Each vane 18 therefore divides the respective pressure space 24 into two pressure chambers 26*a*, 26*b* which act counter to one another and the position of which is indicated in FIG. 3.

The output element 14 is arranged such that it can be rotated with respect to the drive element 12 in a defined angular range. The angular range is limited in one rotational direction of the output element 14 by the fact that the vanes 18 come to bear on in each case one corresponding bounding wall (early stop) of the pressure spaces 24. Analogously, the angular range in the other rotational direction is limited by the fact that the vanes 18 come to bear against the other bounding walls of the pressure spaces 24, which bounding walls serve as a late stop.

By loading one group of pressure chambers 26*a*, 26*b* with pressure and relieving the other group of pressure, the phase relation of the drive element 12 with respect to the output element 14 (and therefore the phase relation of the camshaft 6, 7 with respect to the crankshaft 2) can be varied. The phase relation can be kept constant by loading both groups of pressure chambers 26*a*, 26*b* with pressure.

The output element 14 has a centering collar 25 which is formed on an axial side face 37 which faces the camshaft. In the embodiment which is shown, the centering collar 25 is formed by a depression 27 of the output element 14 in the region about its rotational axis. The centering collar 25 extends along the circumferential direction of the output element 14, the diameter of said centering collar 25 being adapted to the external diameter of the end region of the camshaft 6, 7. A receptacle for the camshaft 6, 7 is therefore formed on the camshaft-side axial side face 37 of the output element 14 for the centered receiving of the camshaft 6, 7 in the radial direction. Centering collars are likewise conceivable, for example, which project out of the axial side face 37 and have, for example, gaps in the circumferential direction.

Figure 4:
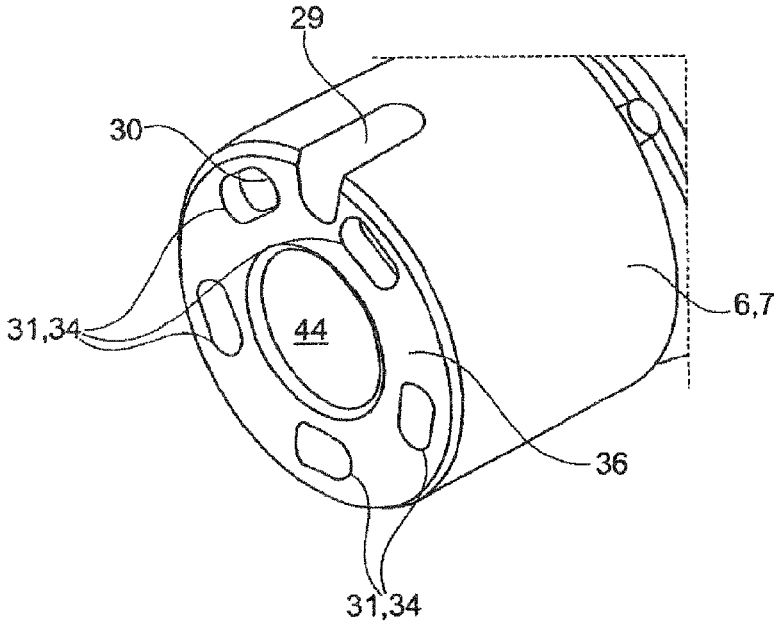
FIG. 4 shows a plan view of that end of a camshaft which is on the side of the output element.

The centering collar 25 has a positively locking element 28 which interacts with a mating positively locking element 29 (FIG. 4) which is formed on the camshaft 6, 7. Here, the positively locking element 28 and the mating positively locking element 29 are formed and arranged in such a way that the camshaft 6, 7 can be inserted into the centering collar 25 only in a defined orientation relative to the output element 14, namely when the positively locking element 28 and the mating positively locking element 29 lie axially directly opposite one another. The positively locking element 28 is configured in one piece with the output element 14. In the embodiment which is shown, said positively locking element 28 is configured as a bulge of the centering collar 25 radially to the inside, and the mating positively locking element 29 is configured as a cutout on an outer circumferential face of the camshaft 6, 7. It goes without saying that a bulge may also be provided on the outer circumferential face of the camshaft 6, 7 and a corresponding bulge of the centering collar 25 may be provided radially to the outside. Embodiments are likewise conceivable, in which the positively locking element 28 is configured as an axial bulge on the output element 14 in the region of the bearing face of the camshaft 6, 7, while the mating positively locking element 29 is configured as a depression on an output element-side side face 36 of the camshaft 6, 7. The reverse case can also of course be present here.

The positionally accurate mounting of the camshaft 6, 7 is facilitated considerably by the integral configuration of the positively locking element 28 or the mating positively locking element 29 with the output element 14 and the camshaft 6, 7. No more pins are necessary which have to be connected to the respective components in a nonpositive or material to material manner. Rather, the axial and radial bulges can be shaped during the production process of the components. In the case of the output element 14, for example, the radial bulge of the centering collar 25 or an axial elevation on the bearing face of the camshaft 6, 7 can be formed during the sintering process without additional method steps. To this end, these features are to be taken into consideration merely in the shaping die, with the result that no additional costs are produced. The number of components of the device 11 is therefore reduced and their production complexity and production costs are lowered.

First pressure medium lines 30 which extend substantially in the axial direction and open at the axial side face 36 of the camshaft 6, 7 via first openings 31 are formed within the camshaft 6, 7. The first pressure medium lines 30 communicate via first radial branch holes 35 with a pressure medium transmitter (not shown) which is arranged on the outer circumferential face of the camshaft 6, 7.

Second pressure medium lines 32 are formed within the output element 14, which second pressure medium lines 32 in each case open firstly into one of the first pressure chambers 26*a* and secondly have a second opening 33 which are formed on the axial side face 37 of the output element 14. Here, the first and second openings 31, 33 lie opposite one another in the axial direction.

In a first embodiment which is shown in FIGS. 2 and 3, the throughflow area (cross-sectional area) of the first openings 31 corresponds to the throughflow area of the first pressure medium lines 30. FIG. 3 shows several options for the configuration of the second openings 33 of the second pressure medium lines 32. They may be configured, for example, as grooves 34, in the present case grooves 34 in the circumferential direction of the output element 14, two adjacent first pressure medium lines 30 and two adjacent second pressure medium lines 32 not communicating with the same groove 34. It is likewise conceivable to configure the second openings 33 with a funnel-shaped extension 38, the funnel-shaped extension 38, starting from the axial side face 37 of the output element 14, tapering continuously toward the second pressure medium line 32 until said funnel-shaped extension 38 assumes the cross-sectional area of said second pressure medium line 32. Elliptical or rectangular second openings 33, for example, are likewise conceivable.

The throughflow area of every second opening 33 is advantageously configured to be greater than the throughflow area of the first pressure medium lines 30. The extent of every second opening 33 both in the radial direction and in the circumferential direction is advantageously configured to be greater than the corresponding extent of the corresponding first opening 31. The greater extent in the radial direction ensures that tolerances are compensated for. As a result of the greater extent in the circumferential direction, orientation errors of the output element 14 with respect to the camshaft 6, 7 in the circumferential direction can be compensated for. This leads, in the case of the positively locking element 28, to it being possible for greater tolerances to be tolerated and to it therefore not being necessary for said positively locking element 28 to be post-machined in a complex way after the shaping process.

A configuration of this type ensures that, even if there are high tolerances, every second opening 33 covers the corresponding first opening 31 completely. As a result, throttling points at the interface between the camshaft 6, 7 and the output element 14 are avoided reliably and complicated post-machining steps are superfluous in the production of the camshaft 6, 7 and the output element 14.

In addition, the first openings 31 can likewise be configured with an enlarged cross-sectional area.

A reversal of the first embodiment is likewise conceivable. In this case, in addition to the radial hole, the second pressure medium lines 32 additionally comprise an axial hole which is configured as a blind hole and opens firstly into the radial hole and secondly as second opening 33 at the axial side face 37 of the output element 14. Here, the first openings 31 are of enlarged configuration as described above (FIG. 4).

In all the embodiments, faulty orientations of the camshaft 6, 7 with respect to the output element 14 in the circumferential direction are not damaging to the function of the device 11. The widened region of the respective openings 31, 33 guarantees a sufficient overlapping area between every first and second pressure medium line 30, 32.

Furthermore, the camshaft 6, 7 has second branch holes 42 which open into an annular space 43 which is arranged between a camshaft hole 44 of the camshaft 6, 7 and the central screw 22. The annular space 43 opens into the central hole 22*a* of the output element 14 and communicates via third pressure medium lines 45 with the second pressure chambers 26*b*.

During the operation of the internal combustion engine 1, the pressure medium flow to and from the pressure chambers 26*a*, 26*b* is controlled by means of a control valve 46. The control valve 46 has an inflow connection P, an outflow connection T and two work connections A, B.

Pressure medium is fed from a pressure medium pump 47 to the control valve 46 via the inflow connection P, while the outflow connection T is connected to a pressure medium reservoir 48. The first work connection A communicates with the first branch holes 35, and the second work connection B communicates with the second branch holes 42.

The control valve 46 can assume three control positions. In a first control position, the inflow connection P is connected to the second work connection B, and the first work connection A is connected to the outflow connection T. Pressure medium therefore passes from the pressure medium pump 47 via the second branch holes 42, the annular space 43 and the third pressure medium lines 45 to the second pressure chambers 26*b*. At the same time, pressure medium is discharged from the first pressure chambers 26*a* via the second pressure medium lines 32, the openings 31, 33, the first pressure medium lines 30, the first branch holes 35 and the first work connection A of the control valve 46 to the pressure medium reservoir 48. The second pressure chambers 26*b* therefore expand at the expense of the first pressure chambers 26*a*, as a result of which, in the illustration of FIG. 3, the output element 14 is rotated counter to the clockwise direction relative to the drive element 12.

In a second control position, none of the work connections A, B is connected to the inflow connection P or the outflow connection T. In this case, the pressure is maintained in the pressure chambers 26*a*, 26*b*, as a result of which the phase relation of the output element 14 relative to the drive element 12 is kept constant in the circumferential direction.

In a third control position, the inflow connection P is connected to the first work connection A, and the second work connection B is connected to the outflow connection T. Pressure medium therefore passes from the pressure medium pump 47 via the control valve 46, the first branch holes 35, the first pressure medium lines 30, the openings 31, 33 and the second pressure medium lines 32 to the first pressure chambers 26*a*. At the same time, pressure medium is discharged from the second pressure chambers 26*b* via the third pressure medium lines 45, the annular space 43, the first branch holes 35 and the second work connection B of the control valve 46 to the pressure medium reservoir 48. The first pressure chambers 26*a* therefore expand at the expense of the second pressure chambers 26*b*, as a result of which, in the illustration of FIG. 3, the output element 14 is rotated in the clockwise direction relative to the drive element 12.

LIST OF DESIGNATIONS

1 Internal combustion engine
2 Crankshaft
3 Piston
4 Cylinder
5 Traction mechanism drive
6 Inlet camshaft
7 Outlet camshaft
8 Cam
9 Inlet gas exchange valve
10 Outlet gas exchange valve
11 Device
12 Drive element
13 Housing
14 Output element
15 Side cover
16 Side cover
17 Hub element
18 Vane
19 Circumferential wall
20 Projection
20*a* Bearing face
21 Chain sprocket
22 Central screw
22*a* Central hole
24 Pressure space
25 Centering collar
26*a* First pressure chamber
26*b* Second pressure chamber
27 Depression
28 Positively locking element
29 Mating positively locking element
30 First pressure medium line
31 First opening
32 Second pressure medium line
33 Second opening
34 Groove
35 First branch hole
36 Axial side face of the camshaft
37 Axial side face of the output element
38 Funnel-shaped extension
42 Second branch hole
43 Annular space
44 Camshaft hole
45 Third pressure medium line
46 Control valve
47 Pressure medium pump
48 Pressure medium reservoir
A First work connection
B Second work connection
P Inflow connection
T Outflow connection

The invention claimed is:

1. A device for variably adjusting valve timing of gas exchange valves of an internal combustion engine, comprising:

a drive element; an output element; and a camshaft, the drive element being connectable via a drive connection with a crankshaft of the internal combustion engine, the output element being connected fixedly to the camshaft so as to rotate with the camshaft and being arranged pivotably with respect to the drive element, an axial side face of the camshaft bearing against an axial side face of the output element, the camshaft defining first pressure medium lines that open at the axial side face of the camshaft via first openings, and the output element defining second pressure medium lines that open at the axial side face of the output element via second openings, the first openings respectively corresponding to the second openings, wherein one of:

an extent of the second openings is greater in a radial direction and in a circumferential direction than an extent of the respective corresponding first openings; and an extent of the first openings is greater in a radial direction and in a circumferential direction that an extent of the respective corresponding second openings; and a positively locking element which engages into a mating positively locking element of the other component being provided on one of the axial side faces which lie on one another, for orienting the output element on the camshaft with regard to its circumferential direction, wherein the positively locking element and the mating positively locking element are formed in one piece with the corresponding component.

2. The device as claimed in claim 1, wherein the positively locking element is configured as an axial projection on one of the side faces.

3. The apparatus as claimed in claim 1, wherein the output element has a centering collar for receiving the camshaft.

4. The apparatus as claimed in claim 3, wherein the positively locking element is configured as a radial bulge on the centering collar.

5. The apparatus as claimed in claim 1, wherein one of the first openings and the second openings are configured as grooves.

6. The apparatus as claimed in claim 1, wherein a throughflow area of each of the second openings is greater than a throughflow area of the respective first pressure lines.

* * * * *

UNITED STATES PATENT AND TRADEMARK OFFICE

CERTIFICATE OF CORRECTION

PATENT NO. : 8,561,582 B2
APPLICATION NO. : 13/003663
DATED : October 22, 2013
INVENTOR(S) : Ahmet Deneri It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 278 days.

Signed and Sealed this
Fifteenth Day of September, 2015

Michelle K. Lee

Michelle K. Lee
*Director of the United States Patent and Trademark Office*